US011851246B2

(12) United States Patent
Taylor et al.

(10) Patent No.: US 11,851,246 B2
(45) Date of Patent: Dec. 26, 2023

(54) COLLAPSIBLE CONTAINER

(71) Applicant: BIG HEART PET, INC., Orrville, OH (US)

(72) Inventors: Alexandra Nicole Taylor, Walkersville, MD (US); Julius Austria Coronel, Copley, OH (US); Rebecca Massie Grey, Dayton, OH (US); Andrew Douglas Gordon, Medina, OH (US); Zachary Parker Willard, Johns Creek, GA (US)

(73) Assignee: BIG HEART PET, INC., Orrville, OH (US)

( * ) Notice: Subject to any disclaimer, the term of this patent is extended or adjusted under 35 U.S.C. 154(b) by 205 days.

(21) Appl. No.: 16/775,336

(22) Filed: Jan. 29, 2020

(65) Prior Publication Data

US 2020/0239196 A1 Jul. 30, 2020

Related U.S. Application Data

(60) Provisional application No. 62/798,894, filed on Jan. 30, 2019.

(51) Int. Cl.
*B65D 35/10* (2006.01)
*B65D 35/44* (2006.01)
(Continued)

(52) U.S. Cl.
CPC ..... *B65D 35/10* (2013.01); *B65D 17/4011* (2018.01); *B65D 17/502* (2013.01);
(Continued)

(58) Field of Classification Search
CPC ..... B26D 1/553; B65D 35/10; B65D 35/44; B65D 17/4011; B65D 17/502;
(Continued)

(56) References Cited

U.S. PATENT DOCUMENTS 4,930,644 A * 6/1990 Robbins, III ..... B65D 1/40 220/8
5,226,551 A * 7/1993 Robbins, III ..... B65D 1/0292 220/666
(Continued)

OTHER PUBLICATIONS https://verdesoft.de/en/aktuelles/39/neues-verpackungskonzept-fuer-tiernahrung; VerDeSoft Packagedesign & Technology; Jul. 14, 2015.
https://www.snap-feed.com/home.html; VerDeSoft GmbH; 2016.

*Primary Examiner* — Lien M Ngo
(74) *Attorney, Agent, or Firm* — Michael A. Olshaysky

(57) ABSTRACT

Pet owners are frustrated with conventional wet pet food packages as it is difficult to remove product from these packages. Traditional metal or plastic containers and flexible pouches are not designed to fully eject product in one step. Rather, the consumer must perform additional steps such as scooping, scraping, tearing, or twisting to entirely remove product. Provided is a collapsible package for wet pet foods. The collapsible package has tapered flexible sidewall, a rigid ring and/or circumferential peripheral flange attached to a top of the sidewall, and a rigid base attached to a bottom of the sidewall. The flexible sidewall is configured to be compressible between an expanded position, at which point product is held in the container, and a collapsed position, at which point product is effectively ejected from the container. A lid can also be attached to the ring and/or circumferential peripheral flange to seal the container.

20 Claims, 6 Drawing Sheets

(51) Int. Cl.
*B65D 17/28* (2006.01)
*B65D 17/50* (2006.01)
*B65D 83/00* (2006.01)

(52) U.S. Cl.
CPC ..... *B65D 35/44* (2013.01); *B65D 83/0055* (2013.01); *B65D 2231/005* (2013.01)

(58) Field of Classification Search
CPC ..... B65D 83/0055; B65D 2231/005; B65D 2251/0093; B65D 2543/00092; B65D 2543/00435; B65D 1/32; B65D 1/40
USPC ..... 206/216; 220/666, 667, 6, 4.08, 4.09, 220/4.28, 4.29

See application file for complete search history.

(56) References Cited

U.S. PATENT DOCUMENTS 5,692,424 A * 12/1997 Wallace ..... A47J 36/00 83/167
D545,137 S * 6/2007 Furlong ..... D7/629
9,079,685 B2 * 7/2015 Sudakoff ..... B65D 43/0218
9,221,582 B2 * 12/2015 Wheeler ..... B65D 21/086
2005/0127074 A1 * 6/2005 Kusuma ..... B65D 21/086 220/6
2012/0205371 A1 * 8/2012 Lee ..... B65D 47/286 220/8
2013/0075393 A1 * 3/2013 Haynie ..... B65D 11/04 220/6
2013/0277364 A1 * 10/2013 Kusuma ..... A45F 3/20 220/8
2014/0061193 A1 * 3/2014 Sudakoff ..... B65D 43/0218 220/200
2015/0034661 A1 * 2/2015 Cooper ..... B65B 61/24 220/666

* cited by examiner

COLLAPSIBLE CONTAINER

CROSS-REFERENCE TO RELATED APPLICATION

This application claims the priority and benefit of U.S. Provisional Patent Application Ser. No. 62/798,894, filed Jan. 30, 2019, titled "Collapsible Container", the entirety of which is incorporated herein by reference.

BACKGROUND

Field of the Invention

The present invention relates generally to containers, packaging, and packaging systems for use with packaged food products including wet or moist consumer foods and wet or moist pet foods. More specifically, the invention provides a container with a collapsible sidewall attached to a ring of rigid material which facilitates ease of ejection of the packaged food product from the container after removal of a lid used to seal the opening of container.

Description of the Related Art

Pet owners are frustrated with the options currently available to them regarding how wet pet food, specifically wet cat-food, is packaged and how to use these packages. Similar problems exist with consumer food, such as canned tuna fish or canned chicken. A major complaint is how difficult it is to remove product from the package. These problems extend to numerous forms of packaging for consumer and pet food including metal cans, rigid plastic containers, and even flexible pouches. Metal cans and plastic containers are particularly challenging in this respect due to their bulk rigidity. Although pouches are flexible, consumers still have problems extracting the food product because flexible pouches have folds or gussets in the bottom which make complete removal of product from the pouch difficult and unlikely. This results in product waste that is not economical to consumers. This is a reason why pâté, a leading form of wet cat food, is usually not sold in a pouch. In addition, food manufacturers and consumers alike are concerned about the sustainability of conventional packaging for wet or moist consumer and pet food. Further metal cans and plastic containers are heavy and bulky and are simply costly to produce and to transport. This increases the environmental footprint associated with this sort of packaging.

To overcome issues with conventional wet or moist pet food packaging, consumers typically utilize a fork or other utensil to extract product from the package. The fork or utensil is then used to scrape residual product from the interior of the package and to break up product into manageable, bite-sized pieces, prior to serving to a pet.

The present invention solves the problems associated with conventional wet food packaging. By utilizing a combination of rigid materials with flexible or pliable materials, the invention allows consumers to easily and neatly eject product from the collapsible container without requiring the additional step of scraping product from the collapsible container. The invention also contemplates features for breaking product apart into smaller, bite-sized pieces while the product is being ejected from the collapsible container, thereby saving the consumer another step in the typical procedure followed when using conventional packaging and eliminating the need to use any additional utensils entirely.

SUMMARY

An exemplary embodiment of the present invention provides a collapsible container for packaged food product. The collapsible container comprises a tapered sidewall of flexible or pliable material and a ring of rigid material having an outwardly extending edge, where the ring attaches to a top of the sidewall and defines an opening of the collapsible container. Optionally, the container also includes a cutting mechanism, such as a screen or mesh for example, spanning the opening of the container and attached to the top of the sidewall. Optionally, the collapsible container also includes a rigid overcap, and, in such embodiments the ring of rigid material has an outwardly extending edge including a flange, where the rigid overcap attaches to the flange and seals the collapsible container. In certain optional examples that include a cutting mechanism spanning the opening of the collapsible container, the rigid overcap also covers the cutting mechanism and can be used to reseal the collapsible container.

Another exemplary embodiment of the present invention provides a collapsible container comprising a sidewall of flexible or pliable material, a circumferential peripheral flange of rigid material attached to a top end of the sidewall, and a rigid base at a bottom end of the sidewall. Further, the circumferential flange defines an opening at an end of the collapsible container. Still further, the flexible or pliable material is configured to be compressed between the flange and the rigid base of the collapsible container. The materials forming the collapsible container can withstand commercial processing conditions, such as aseptic or retort processing.

Another exemplary embodiment of the present invention provides a collapsible container comprising a rigid top with a circumferential peripheral flange, a rigid base, and a sidewall made of a flexible or pliable material disposed between and fixed to the flange and the rigid base. Further, the collapsible container is compressible between an expanded position, with the flange spaced upwardly away from the rigid base to form the container interior package volume, and a collapsed position with the flange positioned substantially near the rigid base. In the collapsed position any packaged food product contained in the collapsible container is effectively ejected from the container's interior package volume.

In certain embodiments, the collapsible container includes a cutting mechanism, e.g., screen or mesh, spanning the opening. Such a cutting mechanism may also include one or more metal wires, plastic wires, and combinations thereof.

The collapsible container may also include a lid adapted to seal the opening of the collapsible container. Such a lid may be a onetime use lid, such as a pull top lid or peelable film. Conversely, the lid may be a reusable lid that is adapted to be connected to the outwardly extending edge of the ring, thereby sealing the collapsible container.

In certain embodiments, the rigid material forming the ring and rigid bottom may be selected from the group consisting of metal, plastic, thermoplastic, oleoresin, and combinations thereof. Such material may also be a transparent material, an opaque material, or combinations thereof.

In other embodiments, the ring and rigid bottom may include ergonomic indentations or projections to permit intuitive dispensing of the packaged food product contained therein. For example, a flange may project out from the rigid bottom in a direction opposite the opening, like a plunger in a syringe. Conversely, the ring and/or rigid bottom may include indentations, which may be finger shaped, to assist and guide a consumer during operation, to easily dispense the packaged food product from the collapsible container.

In still other embodiments, the material of the lid may be intentionally weakened, such as with the use of non-penetrating scoring in the lid formed as a membrane. Such an embodiment may assist the consumer in readily dispensing the packaged food product, as well as controlling the direction and speed with which the packaged food product is dispensed from the collapsible container as pressure is applied to the rigid base.

BRIEF DESCRIPTION OF THE DRAWINGS

Additional aspects, features, and advantages of the invention, both as to its structure, assembly, and use, will be understood and will become more readily apparent when the invention is considered in light of the following description of illustrative embodiments made in conjunction with the accompanying drawings, wherein.

DETAILED DESCRIPTION

Figure 1:
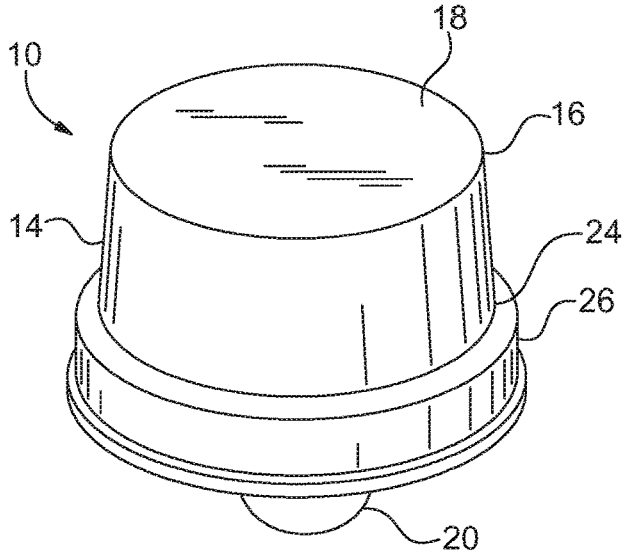
FIG. 1 illustrates a bottom perspective view of an exemplary collapsible container having a rigid top and bottom portion attached to opposing ends of a flexible sidewall, and which contains a moist packaged food product.

Illustrative and alternative embodiments and operational details of the collapsible container 10 for packaged food products of the invention are discussed in further detail below with reference to the figures of this application. The various embodiments of the invention are configured to provide a collapsible container 10 comprising a tapered sidewall 14 of flexible or pliable material and a top ring 26 of rigid material having an outwardly extending edge, where the top ring 26 attaches to a top of the sidewall 14 and defines an opening of the container, which can be sealed closed with a lid 12.

The tapered sidewall 14, which is made of pliable or flexible material, provides for easy dispensing of the packaged food product 22 from the collapsible container 10. In this invention, the word "pliable" is used in reference to a material that is easily distorted and deformed without exceeding its yield and/or tensile strength when external forces are present or applied and does not return to its original form when the force is released or removed. Additionally, the word "flexible" is used in reference to a material that is easily distorted and deformed without exceeding its yield or tensile strength when external forces are present or applied and return to its undistorted or undeformed state or revert to and closely resemble its undistorted or undeformed state when the force is released or removed.

The packaged food product 22 can be sealed within the interior package volume of the collapsible container 10 so that the packaged food product 22 can be commercially processed to be shelf stable and/or ready to eat, and then packaged, transported, stored, and distributed in commerce. The term "shelf stable" is used to refer to commercially-processed food that can be safely stored at room temperature in a sealed container. Shelf stable products include "ready-to-eat" food products, which are commercially-processed foods, and are generally eaten by a consumer or pet after opening the container containing the packaged food product without further processing.

Specifically, the collapsible container 10 is useful for packaging wet or moist, semi-moist, and dry food for pets or consumers. The three basic classes of pet food—wet (a.k.a. moist), semi-moist, and dry—are classified based on moisture content. Moisture content refers to the total water content of a pet food, whether the water was added as free water, a component of the ingredients used in the pet food, or mixtures thereof. Wet or moist pet food contains high water content, e.g., more than 50 percent by weight moisture and more particularly in the range of about 65-85%. This type of pet food is highly palatable and requires commercial processing, specifically aseptic or retort processing, to stabilize it as a ready-to-eat or shelf-stable product for pets. Semi-moist pet food contains about 15 to about 50 percent by weight moisture. Semi-moist pet food is shelf stable in standard polyethylene packages or other conventional packages and does not require aseptic or retort processing to be stable. Dry pet food contains up to about 15 percent moisture by weight and is the most stable of the three classes of pet food. Dry pet food requires neither the aseptic canning of the moist pet food, nor the wrapping of the semi-moist pet food. Preferably, the collapsible container 10 is useful for dry, semi-moist and wet cat foods, cat treats, cat snacks, and cat toppers made with plant and/or meat-based ingredients. It is contemplated that the collapsible container 10 can also be used for dog foods, dog treats, dog snacks and dog toppers.

The collapsible container 10 is also useful for human foods. Examples of human foods include, but are not limited to canned tuna, salmon, or other fish, as well as canned chicken, as well as jams, jelly, peanut butter and other nut butters, and frostings.

The collapsible container 10 is contemplated to be more environmentally sustainable compared to conventional packaging solutions. For example, the collapsible container 10 uses less weight in packaging material. This reduces associated transportation costs. Likewise, the collapsible container 10 takes up less space in the trash in its collapsible form.

When consumers are shopping the store shelf, they will be drawn to the familiar shape associated with conventional packaging, which the collapsible container 10 resembles. The collapsible container 10 may also include branding graphics specifically designed to call out features of the collapsible container 10 and its use and/or the packaged food product 22. However, upon examination, the consumer will discover that the combination of a rigid base 18, a rigid top ring 26, and a flexible or pliable sidewall 14 of the package design provide for complete evacuation of the packaged food product 22 from the collapsible container 10. The consumer will also understand that the simplified method of operation does not require the user to perform additional steps such as scooping, scraping, tearing, or twisting to remove packaged food product. Further the tapered-shape of the sidewall 14 also promotes ease in evacuation of packaged food product 22 because a suction is not formed when the packaged food product is ejected as the container 10 is operatively collapsed during use.

As an example, a consumer can use the collapsible container 10 by removing an optional overcap 30, if present, removing and discarding any lid 12 that is peelable or pull-top that is present, and then manually collapsing the collapsible container 10 by way of the flexible or pliable sidewall 14 to dispense a desired amount of packaged food product 22 from the collapsible container 10. The optional overcap 30 can be replaced to protect any product contents remaining for later use. While collapsing the collapsible container 10, the consumer holds the collapsible container 10 between forefingers and thumbs and manually pushes the rigid base 18 towards the rigid top ring 26 which ejects packaged food product from the collapsible container 10. If an optional cutting mechanism 28 (like a mesh or screen) is included as part of the collapsible container 10, then the cutting mechanism 28 breaks the packaged food product into smaller, bite-sized pieces as it is ejected from the collapsible container 10.

Detailed Description of the Figures

Figure 2:
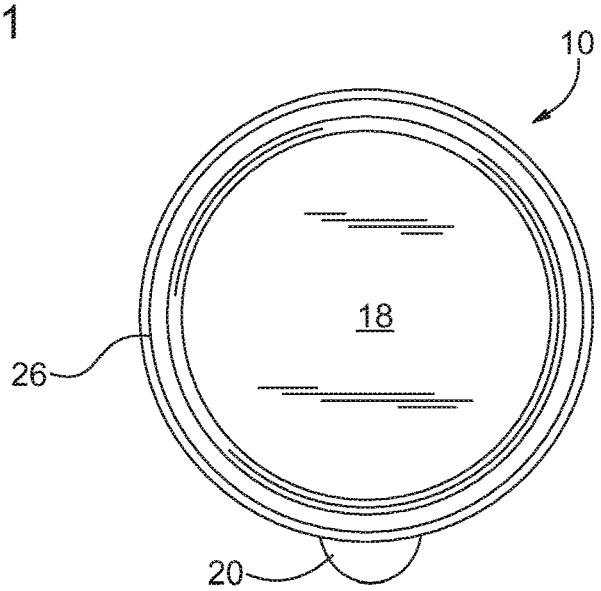
FIG. 2 illustrates a top view of the exemplary collapsible container shown in FIG. 1.
Figure 3:
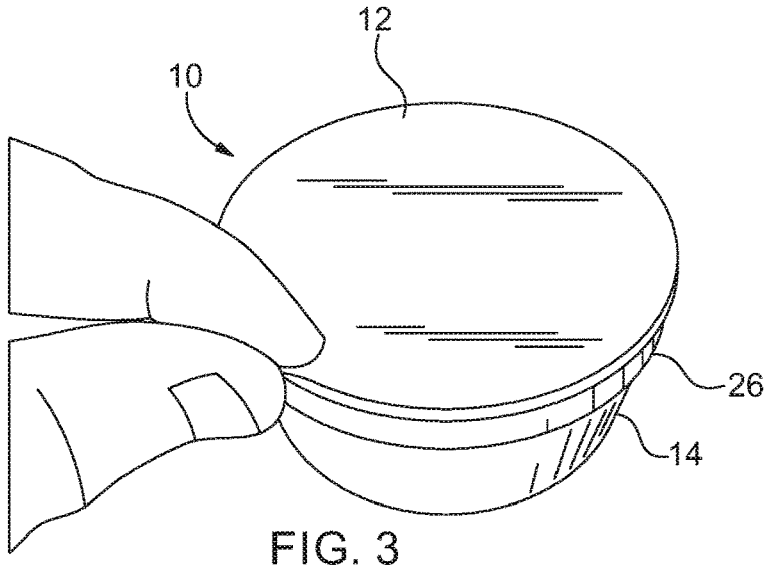
FIG. 3 illustrates a top perspective view of the exemplary collapsible container shown in FIG. 1.

FIGS. 1-3 show a container 10 comprised of a sidewall 14, which is made from a flexible or pliable material, which is also durable and/or puncture resistant. The flexible sidewall 14 forms the overall shape of the collapsible container 10. This overall shape can include any number of geometric configurations such as tapered, cylindrical, frusto-conical, square, or any other custom-made three-dimensional configuration. The flexible sidewall 14 may be opaque, partially opaque, partially transparent, or fully transparent.

FIGS. 1-3 show the collapsible container 10 also including a rigid base 18 which is adjacent to and connected to a bottom end 16 of the flexible sidewall 14. Alternatively, the bottom end 16 of the flexible sidewall 14 may extend inwardly and transversely to the sidewall 14, eventually merging together to form a flexible bottom that, in combination with the sidewall 14, forms a flexible bag-like structure (not shown in FIGS. 1-3). In this configuration the bottom of the flexible bag-like structure remains contiguously in contact with the internally facing side of the rigid base 18. Although it is not shown, it is contemplated that the rigid base 18 can either be attached to the outside surface of the bottom of the flexible bag-like structure, residing therefore outside the flexible bag-like structure, or attached to the inside surface of the bottom of the flexible bag-like structure, residing therefore inside the flexible bag-like structure.

FIGS. 1-3 show a top ring 26 with a circumferential peripheral flange of rigid material adjacent to and connected to the top end 24 of the flexible sidewall 14.

FIGS. 1-3 show a lid 12 also attached to the top ring 26 with a circumferential peripheral flange. The lid 12 hermetically seals the collapsible container 10 to retain packaged food product (not shown) in the collapsible container 10. The lid 12 may feature a pull tab 20 attached to or formed with a peelable film for easy opening of the container 10. When a reusable lid 12 is used, the top ring 26 with circumferential peripheral flange can include a mechanism to operatively engage with the reusable lid. Alternatively, the flexible or pliable sidewall 14 can be sealed directly with a peelable film having a pull tab 20 functioning as a one-use or resealable lid. In this instance, the peelable film can be pulled off using the pull tab 20 and be discarded. One exemplary embodiment of the invention has a plastic, cylindrically-shaped sidewall 14 and a pliable multi-layer film as the rigid base 18, and a lid 12 that is sealed to the sidewall and that is composed of a peelable film having a pull tab 20.

Figure 4:
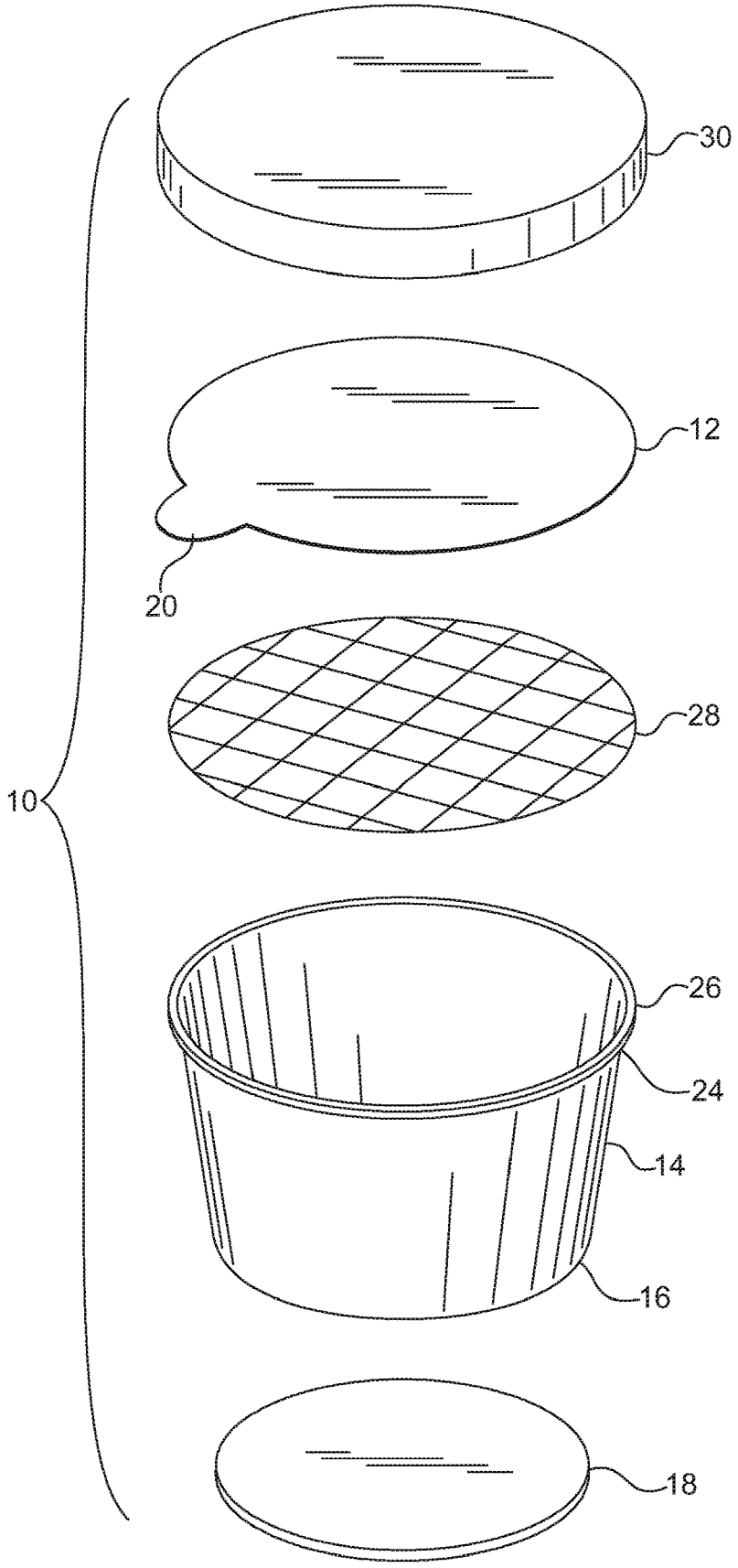
FIG. 4 illustrates an exploded view of an exemplary collapsible container which has rigid top and bottom portions attached to opposing ends of a flexible sidewall and includes a protective and reusable over cap and a product cutting screen to break up the packaged food product upon ejection.
Figure 5A:
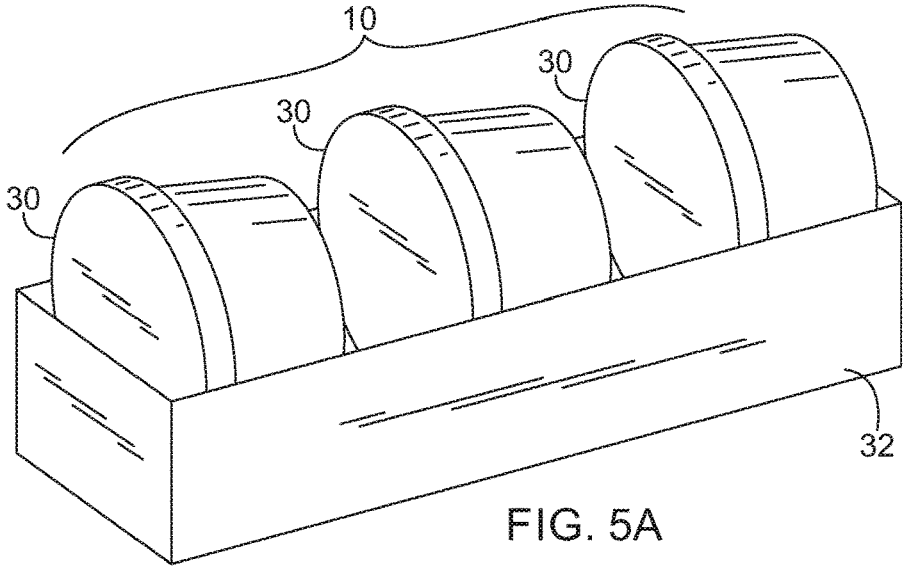
FIG. 5A illustrates a top perspective view of a tray containing a plurality of the exemplary collapsible container shown in FIG. 4.
Figure 5B:
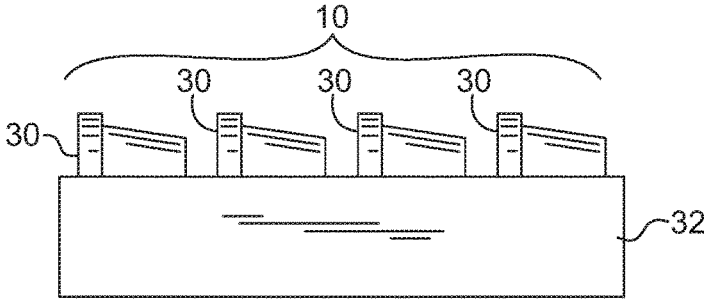
FIG. 5B illustrates a right-side view of the tray shown in FIG. 5A, which contains a plurality of collapsible containers stacked in one exemplary configuration in the tray.
Figure 5C:
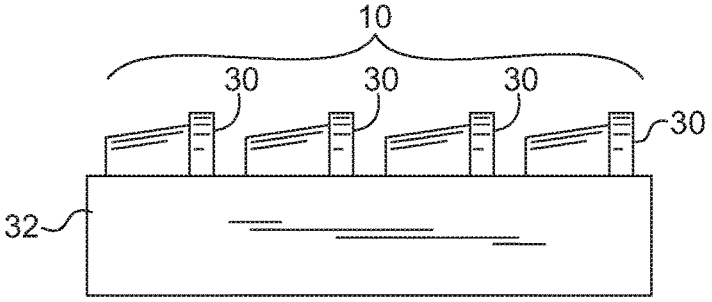
FIG. 5C illustrates a left-side view of the tray show in FIG. 5A, which contains a plurality of collapsible containers stacked in one exemplary configuration in the tray.
Figure 5D:
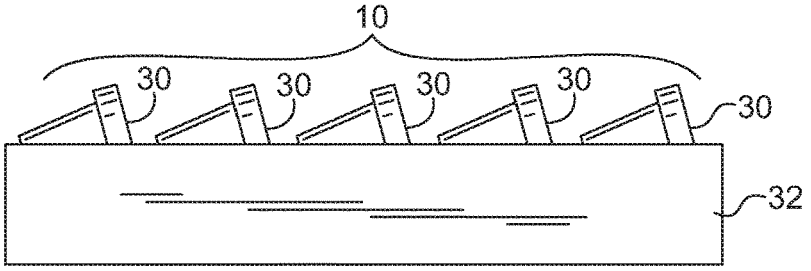
FIG. 5D illustrates a left-side view of an alternative embodiment of a tray containing a plurality of the exemplary collapsible container shown in FIG. 4, where the collapsible containers are stacked in a second exemplary configuration.

FIG. 4 shows an exemplary embodiment of the collapsible container 10 that includes an overcap 30, a peelable film with pull tab 20, and a cutting mechanism 28, such as a rigid screen or mesh, which spans the opening of the collapsible container 10 and is adjacent to the peelable film with pull tab 20. In certain embodiments, the cutting mechanism 28 may take on a different design, such as material with one or more circular or other shaped opening, which is smaller than the opening of the collapsible container 10, or one or more wires transiting the opening of the collapsible container 10.

FIGS. 5A-5D show a tray 32 securing a plurality of collapsible containers 10, where each container 10 is comprised of at least one flexible sidewall made from a flexible or pliable material, a rigid base adjacent and connected to a bottom end of the flexible sidewall, and a top ring and/or circumferential peripheral flange of rigid material is adjacent to and connected to a top end of the flexible sidewall. A lid comprising an overcap 30 is also shown, which is attached to the top ring and/or circumferential peripheral flange.

Base

Generally, the base 18 operates in combination with the sidewall 14 and the top ring 26 and provides a surface on which a consumer applies consistent and uniform pressure when collapsing the container 10 to dispense packaged food product 22.

It is preferred that the base 18 be made of a rigid material and therefore may be referred to as a "rigid base." This rigid material can be any of one or more distinct types of material such as foil, metal, paper, paperboard, corrugated paper, polyolefin plastic, plastic foam, and other suitable materials that are sufficiently rigid to withstand mechanical or physical deformation when pressure is applied by a user when collapsing the container 10 to eject packaged food product 22. The rigid material will also be gas and liquid impermeable and food-grade, meaning it is safe for use when in contact with foods and pet foods.

The rigid material can be comprised of a polymeric material, including plastic or thermoplastic material. Suitable plastic materials can be selected from the group consisting of ethylene polymers, propylene polymers, styrene polymers, vinyl chloride polymers, halogenated olefin polymers, vinyl polymers, acrylic polymers, polyamides, silicone polymers, aluminum oxide polymers, polyacetals, poly ethers polycarbonates, polyesters, polyurethanes, polysulfides, polysulphones, petroleum resins, coumaroneidene resins, silicon rubbers, amino-resins, epoxide resins, alkyd resins, polyallyl esters, and combinations thereof. The material must be a food-grade material meaning that it is safe for direct contact with food. The material may be selected as being generally recognized as safe (GRAS). The material can also include one or more layers of other materials including metal foils.

Ethylene polymers can include, for example and without limitation, polyethylene (PE), high-density polyethylene (HDPE), low-density polyethylene (LDPE), very low-density polyethylene (VLDPE), and linear low-density polyethylene (LLDPE). Propylene polymers include, for example and without limitation, polypropylene (PP). Styrene polymers include; for example and without limitation, polystyrene (PS), expanded polystyrene (EPS), general-purpose polystyrene (GPPS), and styrene butadiene rubber (SBR). Vinyl chloride polymers include, for example and without limitation, polyvinyl chloride. Vinyl acetate polymers include, for example and without limitation, ethylene-vinyl acetate (EVA) and polyvinyl acetate (PVA). Acrylic polymers include, for example and without limitation, polyacrylonitrile (PAN) and poly methyl methacrylate (PMMA). Polyacetals including, for example and without limitation, polyoxymethylene (POM) and polyethylene oxide (PEO). Polyamides include, for example and without limitation, aliphatic, semi-aromatic, and aromatic polyamides. Combination materials may, for example and without limitation, include a blend of acrylonitrile butadiene styrene (ABS), polybutylene terephthalate (PBT), and polyethylene terephthalate (PET) a material having high temperature resistance as well as impact strength.

In alternative embodiments, the base 18 may be made of a semi-rigid material or a flexible material.

The base 18 can be stamped, injection molded, pressure formed, thermoformed, die cut, or formed by other commercially-available fabrication methods. The base 18 can be printed with branding graphics and can be made with any number of configurations or shapes including, but not limited to, circular, square, or any other custom-made configuration. The base 18 can be made from commercially-available standard thickness to economically support the container (i.e. 0.010"-0.100").

The base 18 can also be ergonomically designed to accommodate the human hand for intuitive use. Such an ergonomic design may take the form of one or more finger-shaped indentations, gripping surfaces, or indentations on the bottom surface of the base 18.

The base 18 may be attached to the sidewall 14 (described below) using known methods in the packaging industry including, but not limited to, attachment by a mechanical means, heat sealing, gluing, and adhering using pressure sensitive or thermoset adhesives.

As outlined above, the container 10 may be defined by the merging of the bottom end 16 of the sidewall 14, and the base 18 may be attached to the bottom end 16 of the sidewall 14. In such embodiments, the surface area of the base 18 will be less than or equal to the surface area of the bottom of the container 10.

In other embodiments, the base 18 may include a projection extending outward from the base 18 in a direction away from the opening of the container. For example, the projection may define a handle or plunger adapted to permit the packaged food product 22 of the container 10 to be dispensed with one hand. Alternatively, the base 18 can be formed as one-piece with the sidewall 14 and/or the rest of the container 10.

Top Ring

The top ring 26 operates in combination with the sidewall 14 and base 18 and provides rigidity to the overall package design, a surface to seal the top 24 of the flexible and/or pliable sidewall 14, and lid 12, and hoop strength to maintain seal integrity.

The top ring 26 is made of a rigid material. This rigid material can be any of one or more distinct types of rigid material outlined above for the base 18.

The top ring 26 can be stamped, injection molded, pressure molded, thermoformed, die cut, or formed by other commercially-available fabrication methods. The top ring 26 can be printed with branding graphics and can be made with any number of configurations or shapes including, but not limited to, cylindrical, square, or any other custom-made configuration. The top ring 26 can be made from commercially-available standard thickness materials to economically support the container. By way of non-limiting example, the material thickness may be from about 0.005" to about 0.050".

The top ring 26 can be ergonomically designed to accommodate the human hand for intuitive use and placement. For example, the top ring 26 may include one or more flanges projecting out from a circumference of the top ring 26 in a direction substantially along the plane of the top of the container 10.

Figure 7A:
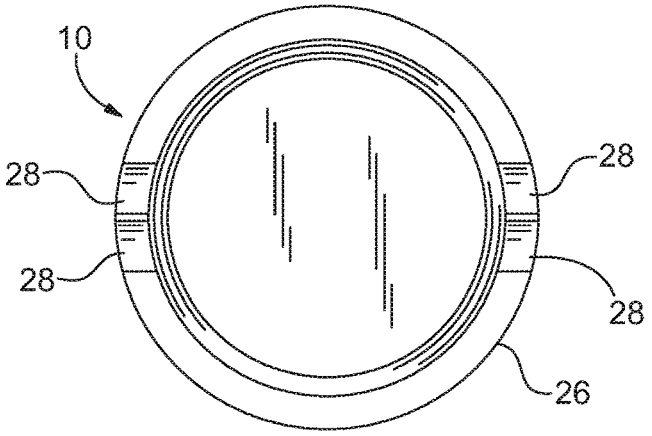
FIG. 7A illustrates a top view of the exemplary collapsible container shown in FIG. 4, and which additionally includes an ergonomic design with finger holding and resting features contemplated for the associated top ring for ease of operation and use of the collapsible container.
Figure 7B:
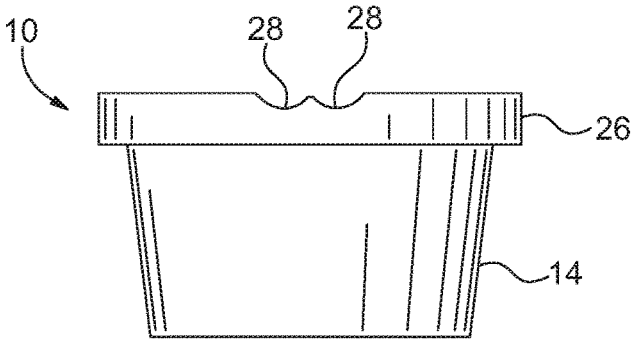
FIG. 7B illustrates a side view of the rigid top ring associated with the exemplary collapsible container shown in FIG. 7A.
Figure 7C:
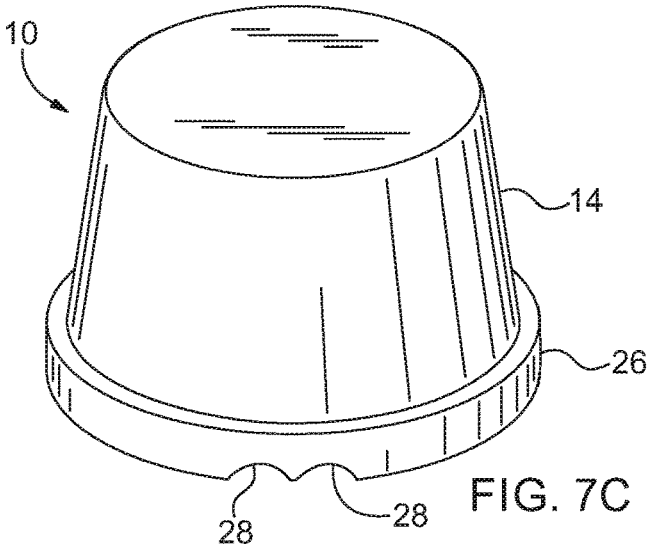
FIG. 7C illustrates a bottom perspective view of the exemplary collapsible container shown in FIG. 7A.

In other embodiments, as shown in FIGS. 7A-7C, the top ring 26 may include one or more indentations 28 for intuitive finger placement. Alternatively, the top ring 26 can include gripping surfaces instead of or in addition to indentations 28 for fingers.

Figure 6A:
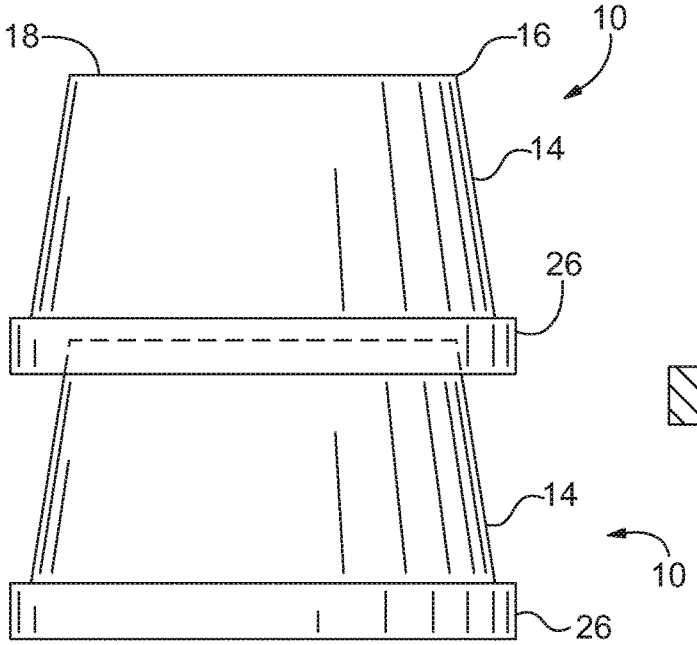
FIG. 6A illustrates a side view of a nesting and stacking configuration contemplated for use in distributing and retail and commercial shelf display of a plurality of exemplary collapsible containers where each container has rigid top and bottom portions attached to opposing ends of a flexible sidewall.
Figure 6B:
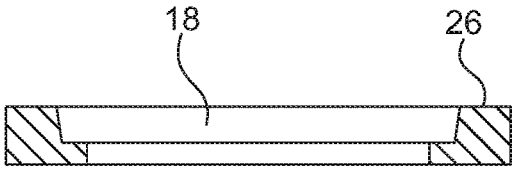
FIG. 6B illustrates a cutaway cross-sectional view of the rigid top ring associated with the exemplary collapsible container shown in FIG. 6A, indicating the nesting and stacking features contemplated for the top ring.
Figure 6C:
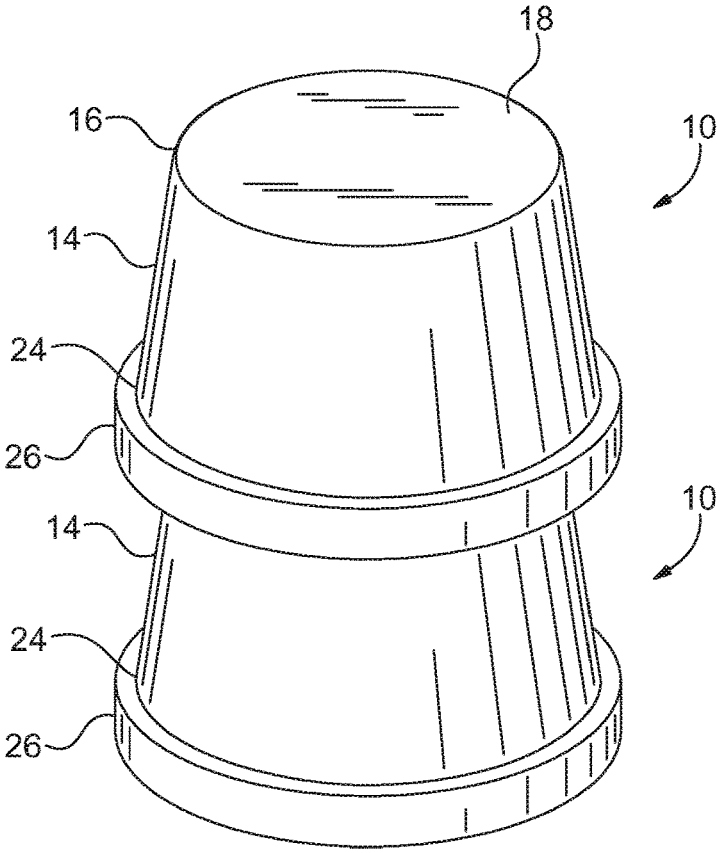
FIG. 6C illustrates a bottom perspective view of the nesting and stacking features contemplated for use in distributing and retail and commercial shelf display of the plurality of exemplary collapsible container shown in FIG. 6A.

In certain embodiments, such as those depicted in FIGS. 6A-C, the top ring 26 can also be recessed to accommodate nesting or stacking of multiple collapsible containers 10 in retail stores or in a consumer pantry. For example, the top ring 26 of a first collapsible container can have a circular indentation recessed into its bottom, see, e.g., FIG. 6B, which has a diameter equal or less that the diameter of the base 18 of a second collapsible container. In other embodiments associated with nesting collapsible containers, the inner rim of the top ring 26 of a first collapsible container may include a circumferential peripheral flange that acts as a stop to prevent the base of a second collapsible container from travelling beyond the top ring 26 of the first container and potentially falling into and making contact with the packaged food product 22 in the first container.

The top ring 26 is attached to the sidewall 14 using known methods in the packaging industry including, but not limited to, attachment by a mechanical means, heat sealing, gluing, and adhering using pressure sensitive adhesive.

A lid 12 also attaches to the top ring 26. The lid 12 is attached using known methods in the packaging industry including, but not limited to, attachment by way of a snap ring or use of any other conventional fastening mechanism.

An overcap 30 can also be used with the container 10 to cover the lid 12 entirely. For example, the outer rim of the top ring 26 may include a circumferential peripheral flange that allows for the overcap to be secured to the top ring 26. In certain embodiments, the top of the overcap 30 can also be recessed to accommodate nesting or stacking of multiple collapsible containers 10 in retail stores or in a consumer pantry. For example, the top of the overcap 30 of a first collapsible container can included a recessed, circular interior platform that has a diameter equal or less that the diameter of a base 18 of a second collapsible container. In other embodiments associated with nesting collapsible containers, the recessed, circular interior platform associated with the top of the overcap 30 of a first collapsible container acts as a stop to prevent the base of a second collapsible container from travelling beyond the overcap 30 of the first collapsible container and potentially falling into and making contact with the packaged food product 22 in the first container.

Sidewall

Figure 8A:
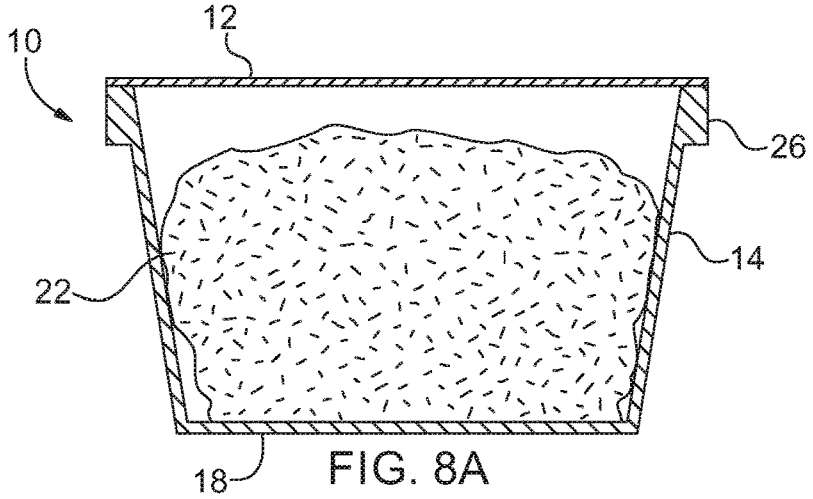
FIGS. 8A-8B illustrate cross-sectional views of operability of an embodiment of the collapsible container having a rigid base and a scored membrane sealing the opening of the container, which is configured to rupture as shown in FIG. 8B when pressure is applied to compress the collapsible container shown in FIG. 8A.
Figure 8B:
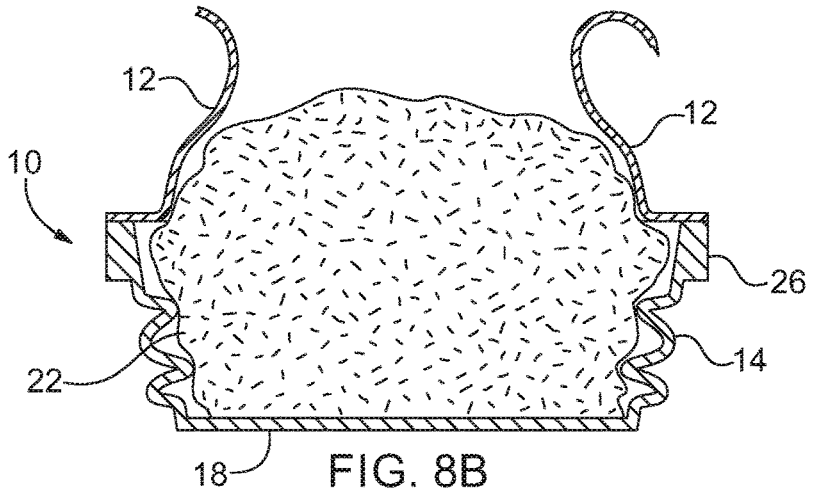

The sidewall 14 operates in combination with the top ring 26 and the base 18, providing operability to the overall package design. The sidewall 14 is disposed between the top ring 26 and the base 18. In the expanded position—shown for example in FIG. 8A, when the collapsible container 10 is filled with packaged food product 22—the sidewall 14 is taut and define the shape and internal package volume of the collapsible container 10 in which packaged food product 22 is retained. Packaged food product 22 is ejected from the container 10 when the top ring 26 and the base 18 are manipulated manually and brought near one other, shown for example in FIG. 8B, which causes the flexible or pliable sidewall 14 to collapse and the effective volume associated with the collapsible container 10 to be minimized. When taut, the sidewall 14 provides support required for shipping and stacking of the product-filled container 10 both on a display shelf and in the consumer's home. When taut, the sidewall 14 also provides space for graphics or a window to draw attention to the packaged food product 22.

The sidewall 14 is made of a flexible or pliable material, i.e., compressible, which is also durable and puncture resistant. This material can be any of one or more distinct types of material such as plastic or thermoplastic, elastomeric material, paper, foil, clear and/or opaque polyolefin film with textural indicators, or other suitable materials including silicon oxide and aluminum oxide linings. By way of an example, and not as a limitation, the sidewall 14 may be made from the materials used to make the base 18 so long as the selected material provides the desired flexible or pliable characteristics for the intended operability of the sidewall 14. The sidewall 14 is sufficiently thick, in order to resist puncture, but not so thick that a consumer is prevented from being able to manually push the rigid base 18 towards the rigid top ring 26 to eject packaged food product 22. Preferred materials are sufficiently flexible or pliable, i.e., compressible, to allow the collapsible container 10 to be compressible between an expanded position with the top ring 26 spaced upwardly away from the base 18 where the container 10 has a defined interior package volume, and a collapsed position with the top ring 26 suitably spaced near the base 18 where the interior package volume of the container 10 is minimized.

The preferred material for the sidewall 14 will be gas and liquid impermeable and food-grade, meaning it is safe for use when in contact with foods and pet foods. The material may be selected as being generally recognized as safe (GRAS).

In an embodiment, the material defining the sidewall 14 can be a flexible material, such as a plastic containing an oleoresin.

The sidewall 14 can be stamped, injection molded, pressure molded, thermoformed, blown, blow molded, die cut, or formed by other commercially-available fabrication methods. The sidewall 14 can be printed with branding graphics and can be made with any number of configurations or shapes including, but not limited to, cup-like, cylindrical, square, or any other custom-made configuration. Optionally, the sidewall 14 can incorporate a window or cut-out portion made of a similar or of a different material which is also transparent to increase visibility of the packaged food product.

The sidewall 14 can be made from commercially-available standard thickness materials to economically support the container. In non-limiting embodiments, a suitable sidewall thicknesses for imparting desired functional characteristics range from about 0.1-10 mil (e.g., 0.005"-0.100").

Figure 8C:
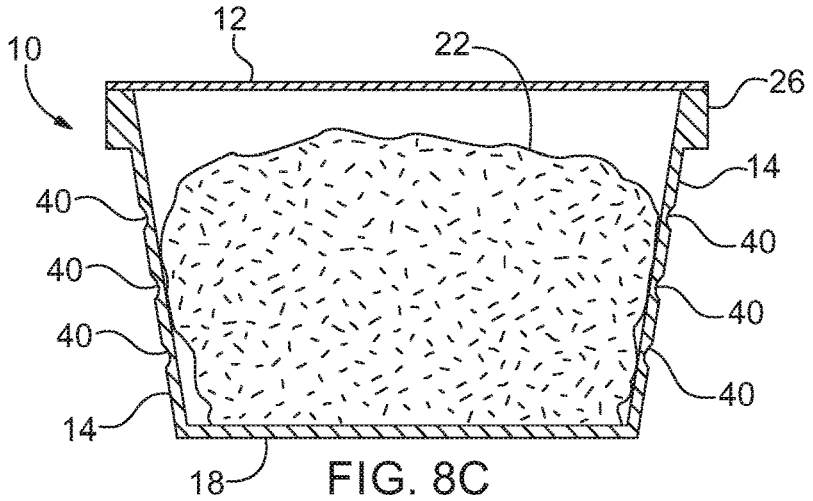
FIG. 8C illustrates a cross-sectional view of an alternative embodiment of the collapsible container having a sidewall with collapse points provided as a plurality of circumferential indents around the sidewall.

In embodiments, the sidewall 14 is uniform in thickness. In alternative embodiments, the sidewall 14 may have portions that are thinner in certain areas to promote overall collapsibility of the container 10, in addition to assisting in directing or designing the collapse to effectively and uniformly dispense the packaged food product 22 from the container 10, particularly in embodiments including any form of a cutting mechanism 28, a lid 12 with an opening (now shown) to direct flow and amount of ejected packaged food product 22, or a lid 12 having scoring to facilitate rupture of the lid 12. For example, as shown in FIG. 8C, the sidewall 14 may include one or more circumferential indents 40, which provide a thin portion around the sidewall 14 to serve as a collapse point(s) to facilitate operability of the collapsible container 10. The one or more circumferential indents 40 around the sidewall 14 may be provided equidistant between the top ring 26 and bottom 18, adjacent the bottom 18, adjacent the top ring 26, or any combination thereof as shown in FIG. 8C. Additionally, one or more collapse points may be formed as thin areas of the sidewall 14 in other configurations (not shown) which may extend linearly or curvilinearly at any angle up to 90 degrees from the top ring 26 to the bottom 18. For example, one or more linear collapse points may be provided linearly at a 45-degree angle to the top ring 26 or bottom 18 to operably promote a twist-like collapse of the container 10. Finally, one or more collapse points may be provided in portions of the sidewall 14.

The sidewall 14 can be ergonomically designed to accommodate the human hand for intuitive use and placement.

As described above, the sidewall 14 can be attached to the top ring 26 and to the base 18 using known methods in the packaging industry including, but not limited to, attachment by a mechanical means, heat sealing, gluing, and adhering using pressure sensitive adhesive.

Together, the sidewall 14, top ring 26, and bottom 18 can be assembled to form any conventional shape container 10 including, but not limited to, round, oval, and rectangular shape container. Alternatively, the sidewall 14, top ring 26, and bottom 18 can be assembled to form unique shapes as well. One embodiment of a container 10 has a capacity of from about 0.5 to 12 ounces of product 22. Another embodiment of a container 10 has a height of from about 0.5 to 5 inches. These embodiments are only examples and larger and smaller, as well as shorter and taller containers are also contemplated.

Lid

The lid 12 can be made of foil, paper, polyolefin plastic, plastic foam, and other suitable materials. The lid 12 can be made from a peelable, laminated, polyolefin plastic film or by other commercially-available fabrication method. The lid 12 will provide product protection and a desired barrier to achieve ideal shelf life. The lid 12 can be printed with branding graphics and can include any number of configurations such as cylindrical, square, or any other custom-made configuration. The lid 12 can be made from commercially-available standard thickness material to economically support the collapsible container 10. By way of a non-limiting embodiment, the thickness of the lid 12 can range from about 0.010" to about 0.100". The lid 12 can be ergonomically designed to accommodate the human hand for intuitive use and removal. The lid 12 can be mechanically attached, heat sealed, or attached by pressure sensitive or thermoset adhesive to the end of the top ring 26.

The lid 12 hermetically seals the container 10 to retain packaged food product 22 in the container 10 and, optionally, includes an overcap 30, which provides the ability to reseal unused products for later use after the lid 12 is removed. The lid 12 may also, optionally, be configured such that multiple collapsible containers 10 are stackable and, accordingly, may be recessed in design as described previously to accommodate a nesting or stacking at a retail store or in consumer pantry. For example, a top ring 26, a lid 12, or an overcap 30 may be formed having a flange, recessed platform, or configured with an inset or other structure to receive a portion of the bottom of another container. The lid 12 may be also configured to display graphics and/or instructions for use.

The lid 12 is made of a rigid, semi-rigid, flexible, or pliable material, and many conventional lids are suitable for use with the container 10. For example, the lid 12 can be made from a semi-rigid rotary blow-molded plastic that includes branded icons or designs in the lid mold. The lid 12 can be transparent, translucent, or opaque, based, in part, on the desire for optical inspection or display of the container's contents, and/or the need to limit light entering the container 10.

The lid 12 has a size and shape that matches the size and shape of the top ring 26 to which it attaches. For example, the lid 12 can be made with any number of configurations or shapes including, but not limited to, cylindrical, square, or any other custom-made configuration. In one non-limiting embodiment, the lid 12 fits a collapsible container 10 having capacity for about 3 to 12 ounces of product. However, this embodiment is only an example and larger and smaller lids 12 are also contemplated. In non-limiting embodiments, suitable lid thicknesses for imparting desired functional characteristics range from about 1 to about 10 millimeters.

In certain embodiments where the lid 12 comprises a membrane or film, the lid 12 may be adapted to rupture before the sidewall 14 when pressure is applied by a user attempting to collapse the container 10 to eject product 22. For example, the exterior surface of the lid may be scored. In other embodiments, the lid 12 may be thinner than the sidewall 14.

Multi-Packs

In certain embodiments, multiple containers 10, each containing a single serving of packaged food product 22, may be attached to one another by way of the top rings 26. Furthermore, the collapsible containers 10 may be connected in a linear fashion, such as a 1 by 6 configuration (i.e., a linear configuration), or in groups such as 2 by 6 groups (i.e., an egg carton configuration).

All the materials used to make the collapsible container 10 of the invention are suitable for, i.e., capable of withstanding, exposure to thermal or non-thermal conditions used in commercial processing including, but not limited to, retort processing for pasteurization or sterilization, aseptic processing, and high- and ultra-high-pressure processing (HPP/UHP).

Although the invention has been described with reference to specific embodiments, these embodiments are illustrative only and not limiting. Many other applications and embodiments of the invention will be apparent considering this disclosure and the following claims. Accordingly, it is intended that the invention embraces all such alternatives, modifications, and variations as falling within the scope of the claims below.

The invention claimed is:

1. A container for food comprising:

a tapered sidewall of flexible or pliable material;

a ring of rigid material having an outwardly extending edge, the ring attached to a top of the sidewall and defining an opening of the container; and a rigid base attached to a bottom of the sidewall and defining a bottom of the container, the rigid base having a base surface area and the bottom of the container having a bottom surface area, wherein the base surface area is less than or equal to the bottom surface area, whereby a slope associated with the tapered sidewall is a continuous straight line between the rigid base and the ring.

2. The container of claim 1, further comprising a cutting mechanism spanning the opening of the container, the cutting mechanism comprising metal wires, plastic wires, or combinations thereof.

3. The container of claim 1, further comprising a lid adjacent to the opening of the container and operatively connected to the outwardly extending edge of the ring, wherein the lid is adapted to seal the container.

4. The container of claim 3, wherein the lid is a pull top lid or includes a peelable film.

5. The container of claim 1, wherein the rigid material is selected from the group consisting of metal, plastic, oleoresin, and combinations thereof.

6. The container of claim 1, wherein the rigid material comprises a transparent material, an opaque material, or combinations thereof.

7. The container of claim 1, wherein the ring or rigid base include an ergonomic indentation or gripping surface.

8. A food package comprising:

a sidewall of flexible or pliable material, a circumferential peripheral flange of rigid material attached to a top end of the sidewall, and a rigid base at a bottom end of the sidewall, the rigid base having a surface area, whereby the circumferential flange has an interior circumference defining an opening area at an end of the package, whereby the flexible material is configured for compression between the flange and the base of the food package, whereby the surface area of the rigid base is less than or equal to the opening area, and whereby a slope associated with the tapered sidewall is a continuous straight line between the rigid base and the ring.

9. The package of claim 8, further comprising a cutting mechanism spanning the opening of the package, the cutting mechanism comprising metal wires, plastic wires, or combinations thereof.

10. The package of claim 8, further comprising a lid adjacent to the opening of the package and operatively connected to the circumferential flange, wherein the lid is adapted to seal the package.

11. The package of claim 10, wherein the lid is a pull top lid or includes a peelable film.

12. The package of claim 8, wherein the rigid material is selected from the group consisting of metal, plastic, oleoresin, and combinations thereof.

13. The package of claim 8, wherein the rigid material comprises a transparent material, an opaque material, or combinations thereof.

14. The package of claim 8, wherein the circumferential peripheral flange or rigid base include an ergonomic indentation or gripping surface.

15. A collapsible container comprising:

a rigid top circumferential peripheral flange having an interior circumference defining an opening area;

a rigid base having a surface area; and a flexible sidewall disposed between and fixed to the flange and the base, whereby the surface area of the rigid base is less than or equal to the opening area, whereby a slope associated with the tapered sidewall is a continuous straight line between the rigid base and the circumferential peripheral flange, and whereby the collapsible container is compressible between an expanded position with the flange spaced upwardly away from the base and forming a container interior and a collapsed position with the flange positioned substantially near the base.

16. The container of claim 15, further comprising a cutting mechanism spanning the rigid top circumferential peripheral flange, the cutting mechanism comprising metal wires, plastic wires, or combinations thereof.

17. The container of claim 15, further comprising a lid operatively connected to the rigid top circumferential peripheral flange, wherein the lid is adapted to seal the container.

18. The container of claim 17, wherein the lid is a pull top lid or includes a peelable film.

19. The container of claim 15, wherein the rigid top circumferential peripheral flange and rigid base are comprised of material selected from the group consisting of metal, plastic, oleoresin, and combinations thereof.

20. The container of claim 15, wherein the rigid top circumferential peripheral flange or rigid base include an ergonomic indentation or gripping surface.

* * * * *